US006942259B2

(12) United States Patent
Marzolf et al.

(10) Patent No.: US 6,942,259 B2
(45) Date of Patent: Sep. 13, 2005

(54) LATCH ASSEMBLY

(75) Inventors: Ricci L. Marzolf, New Hampton, IA (US); Joe Daniel Knight, Nashua, IA (US); Bruce E. Kallevig, Monticello, MN (US); Bruce E. Frohman, Robbinsdale, MN (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 10/316,357

(22) Filed: Dec. 11, 2002

(65) Prior Publication Data

US 2004/0113433 A1 Jun. 17, 2004

(51) Int. Cl.[7] ..... E05C 3/06
(52) U.S. Cl. ..... 292/216; 292/24
(58) Field of Search ..... 292/216, 11, 24, 292/27, 56, 336.3

(56) References Cited

U.S. PATENT DOCUMENTS

| | | | | | |
|---|---|---|---|---|---|
| 621,574 | A | * | 3/1899 | Kinsey | 292/24 |
| 1,574,023 | A | * | 2/1926 | Crompton et al. | 292/24 |
| 2,181,393 | A | * | 11/1939 | Crooks | 292/25 |
| 2,506,943 | A | * | 5/1950 | Shreve | 292/30 |
| 3,179,997 | A | * | 4/1965 | Jalinaud | 24/645 |
| 3,532,373 | A | * | 10/1970 | Poe | 292/47 |
| 3,561,802 | A | * | 2/1971 | Brockway | 292/49 |
| 3,561,807 | A | * | 2/1971 | Ploughman | 292/216 |
| 3,666,305 | A | * | 5/1972 | Schlichter | 292/48 |
| 3,784,241 | A | * | 1/1974 | Pickles | 292/216 |
| 3,857,594 | A | * | 12/1974 | Pastva, Jr. | 292/27 |
| 3,933,330 | A | * | 1/1976 | Gwin | 248/371 |
| 4,836,707 | A | * | 6/1989 | Myers | 403/322.4 |
| 5,069,491 | A | * | 12/1991 | Weinerman et al. | 292/48 |
| 5,127,686 | A | * | 7/1992 | Gleason et al. | 292/216 |
| 5,171,048 | A | * | 12/1992 | Weinerman et al. | 292/45 |
| 5,192,096 | A | * | 3/1993 | Weinerman et al. | 292/45 |
| 5,193,861 | A | * | 3/1993 | Juga et al. | 292/49 |
| 5,209,530 | A | * | 5/1993 | Kolloch | 292/27 |
| 5,520,423 | A | * | 5/1996 | Finkelstein et al. | 292/146 |
| 5,725,260 | A | * | 3/1998 | Eikmeier et al. | 292/129 |
| 5,901,990 | A | * | 5/1999 | McMillan | 292/195 |
| 5,915,766 | A | * | 6/1999 | Baumeister et al. | 292/341.15 |
| 5,997,056 | A | * | 12/1999 | Yamagishi | 292/341.17 |
| 6,158,787 | A | * | 12/2000 | Kutschat | 292/214 |
| 6,471,260 | B1 | * | 10/2002 | Weinerman et al. | 292/216 |
| 6,474,704 | B1 | * | 11/2002 | Rathmann et al. | 292/201 |
| 6,679,531 | B2 | * | 1/2004 | Rogers et al. | 292/216 |

* cited by examiner

*Primary Examiner*—Robert J. Sandy
*Assistant Examiner*—Thomas Ho
(74) *Attorney, Agent, or Firm*—Wood, Phillips, Katz, Clark & Mortimer

(57) ABSTRACT

A latch assembly is provided for a movable closure element. The latch assembly has a housing and a first rotor that is movable relative to the housing selectively between a) a first latched position and b) a release position. The first rotor is biased towards the release position and has a first throat to receive a strike element. The latch assembly further consists of an operating assembly having a latched state and an unlatched state The operating assembly in the latched state releasably maintains the first rotor in the first latched position. The operating assembly has a catch arm that is movable relative to the housing from a first position into a second position to thereby change the operating assembly from the latched state into the unlatched state. The operating assembly further has a catch block that is movable floatingly relative to the catch arm from a) an engaged position with the catch arm in the first position into b) a disengaged position as an incident of the catch arm moving from its first position into its second position. The catch block in the engaged position causes the first rotor to be maintained in the first latched position.

35 Claims, 6 Drawing Sheets

LATCH ASSEMBLY

BACKGROUND OF THE INVENTION

1. Field of the Invention

This invention relates to latch assemblies and, more particularly, to a latch assembly that can be used to releasably maintain a movable closure element in a desired position relative to a support therefor.

2. Background Art

Movable closure elements are used in many industries in both static environments and on moving equipment. These closure elements are commonly pivoted, or translated, between different positions, normally opened and closed positions, to selectively block and allow access to, a space fronted by the closure element.

An exemplary latch assembly, utilized on the above type of closure element, is shown in U.S. Pat. No. 6,158,787, to Kutschat. Kutschat employs two throated rotors 16 which are repositionable to cooperatively engage with a strike element 4. The rotors 16 are designed to be selectively maintained in secondary latched positions, as shown in FIG. 7B, and primary latched positions, as shown in FIG. 7C. The primary and secondary latched positions are maintained by the end of an L-shaped arm 28, which is movable about a pivot 56 between positions wherein the arm 28 is engaged with the rotors 16, to maintain their latched positions, and disengaged from the rotors. The free end of the arm 28 is spaced from the pivot 56 and travels in an arcuate path between its rotor-engaged and rotor-disengaged positions. Accordingly, as the arm 28 is pivoted to effect disengagement, the rotor 16 most remote from the pivot 56 must be pivoted to clear the arcuately moving free end of the arm. As a result, significant resistance to pivoting of the arm 28 may be imparted by the rotor 16.

Additionally, the impeding rotor 16 must be mounted to permit the additional pivoting movement required to disengage the arm 28. This could put constraints on the manner in which the rotors 16 are mounted to the supporting housing 8.

Still further, the arcuate path traveled by the arm free end may, depending upon the particular cooperating arrangement between the arm and rotors 16, place unwanted restrictions on, or complicate, the design of the cooperating portions of the rotors 16 and arm 28.

Designers of this type of latch assembly strive to simplify design, without compromising functionality. In the interest of simplifying design, it is common to reduce the number of component parts. This may contribute to efficiency from the standpoint of inventory control, number of manufacturing steps, etc. The industry is constantly looking for ways to make designs of these latch assemblies more economically feasible while at the same time improving operating characteristics thereof.

SUMMARY OF THE INVENTION

In one form of the invention, a latch assembly is provided for a movable closure element. The latch assembly has a housing and a first rotor that is movable relative to the housing selectively between a) a first latched position and b) a release position. The first rotor is biased towards the release position and has a first throat to receive a strike element. The latch assembly further consists of an operating assembly having a latched state and an unlatched state The operating assembly in the latched state releasably maintains the first rotor in the first latched position. The operating assembly has a catch arm that is movable relative to the housing from a first position into a second position to thereby change the operating assembly from the latched state into the unlatched state. The operating assembly further has a catch block that is movable floatingly relative to the catch arm from a) an engaged position with the catch arm in the first position into b) a disengaged position as an incident of the catch arm moving from its first position into its second position. The catch block in the engaged position causes the first rotor to be maintained in the first latched position.

In one form, with the catch block in the engaged position, the catch block directly engages the first rotor to maintain the first rotor in the first latched position.

The catch block may be mounted for pivoting movement relative to the catch arm.

In one form, the catch block has an angular orientation relative to the housing. The catch block is maintained in substantially the same angular orientation relative to the housing as the catch block changes between the engaged and disengaged positions.

In one form, the catch block is biased towards an operating angular orientation relative to the housing.

A single spring element may be used to both bias the catch block towards the operating angular orientation and bias the first rotor towards the release position. In one form, the single spring element is a formed wire.

In one form, the latch assembly includes a second rotor movable relative to the housing selectively between a) a first latched position and b) a release position. The second rotor has a second throat to receive a strike element. The first and second rotors in their respective first latched positions are arranged so that the first and second throats cooperatively define a receptacle for a strike element.

The second rotor may likewise be biased toward its release position.

In one form, the catch block in the engaged position causes the second rotor to be maintained in its first latched position.

In one form, a bias force is exerted on the catch block at first and second spaced locations to thereby bias the catch block towards the operating angular orientation.

In one form, the single spring element exerts a bias force on the catch block at the first location to thereby bias the catch block towards the operating angular orientation and biases the first rotor towards its release position.

In one form, a second single spring element exerts a bias force on the catch block at the second location to thereby bias the catch block towards the operating angular orientation and biases the second rotor towards its release position.

In one form, the catch block is pivotable relative to the catch arm around a first axis, with the first rotor being pivotable relative to the housing around a second axis. The first and second axes are substantially parallel to each other.

In one form, the catch block and catch arm cooperate to limit pivoting of the catch block relative to the catch arm to a predetermined range.

In one form, the formed wire has a first free end and a second free end, and the first free end is engaged with the catch block, with the second free end engaged with the first rotor.

In one form, the housing has first and second parts joined by an axle, with the formed wire being wrapped around the axle.

In one form, the latch assembly is provided in combination with a movable closure element.

The latch assembly and movable closure element may further be provided in combination with a support for the closure element, with the closure element movable relative to the support between first and second positions. A strike element on the support is received by the first throat on the first rotor with the closure element in its first position.

In one form, the first rotor is movable relative to the housing into a second latched position and the operating assembly has a second latched state wherein the operating assembly maintains the first rotor in the second latched state.

The invention is further directed to the combination of a) a closure element, b) a support for the closure element which is mounted for selective movement relative to the support between first and second positions, c) a strike element on the support, and d) a latch assembly on the movable closure element, as described above.

The operating assembly may include a first actuator element that is movable relative to the catch arm to move the catch arm from its first position into its second position.

The actuator element may include a graspable handle to facilitate movement of the first actuator element.

The operating assembly may further include a second actuator element movable relative to the catch arm to move the catch arm from its first position into its second position.

In one form, the second actuator element is movable relative to the catch arm without causing movement of the first actuator element.

DETAILED DESCRIPTION OF THE DRAWINGS

Figure 1:
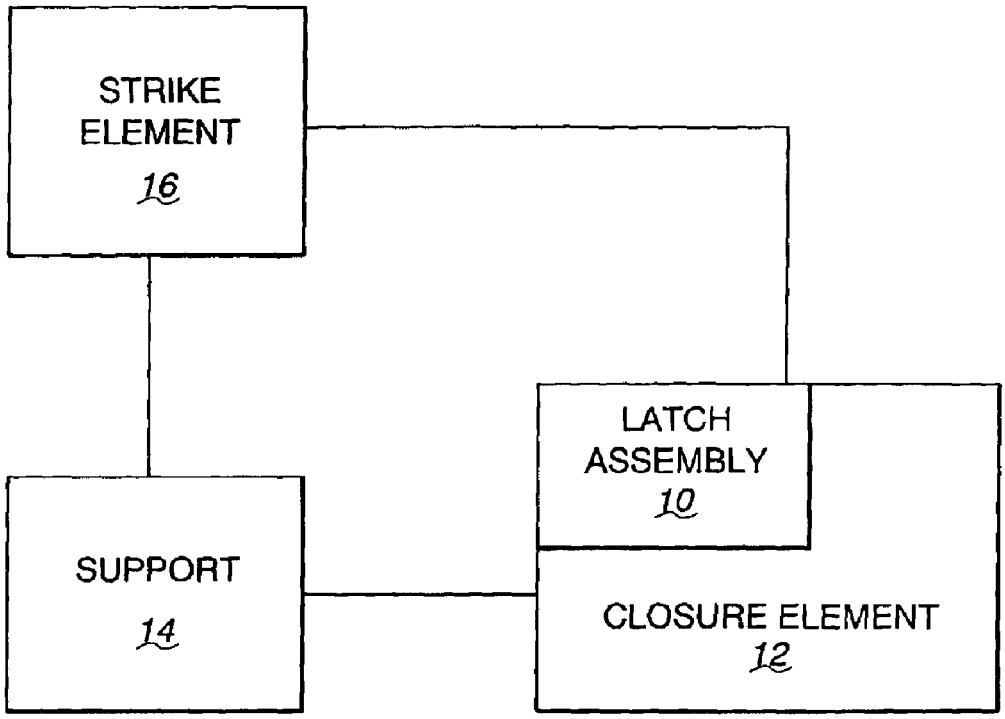
FIG. 1 is a schematic representation of a latch assembly for a movable closure element, mounted to a support, according to the present invention.

The present invention is directed to a latch assembly, as shown generically at 10 in FIG. 1. The latch assembly 10 is associated with a closure element 12 which is mounted for movement relative to a support 14 between first and second positions. The first and second positions may be closed and opened positions between which the closure element 12 is moved to selectively block, and permit access to, a space associated with the support 14. However, it is not necessary that the closure element 12 be movable between the first and second positions strictly for that purpose. The support 14 can be virtually any structure. As just an example, the support 14 might be part of a static environment, such as on a building, or a cabinet. Alternatively, the support 14 could be on a moving vehicle, such as a tractor. In the latter case, the closure element 12 might be a door or window structure that is either pivotably mounted, or mounted for translational movement between first and second positions. The support 14 has an associated strike element 16, which cooperates with the latch assembly 10 to releasably maintain the closure element 12 in one of the first and second positions therefor.

Referring now to FIGS. 2–8, the latch assembly 10, according to the present invention, consists of a housing 18 with joinable first and second housing parts 20, 22. The rectangular shape of the housing 18 is but exemplary. The housing parts 20, 22 are joined through a plurality of, and in this case four, hollow cylindrical axles 24, 26, 28, 30. Three of the axles 24, 26, 28 have the same construction. Exemplary axle 24 has a cylindrical main portion 32 and reduced diameter, axially spaced ends 34, 36 which are pressed through complementary openings 38, 40 on the housing parts 20, 22, respectively. The ends 34, 36 project through their respective openings 38, 40 and are deformed externally of the housing parts 20, 22 against an annular chamfer 42 (shown only for the housing part 20) around each opening 38, 40. The axles 26, 28, 30 are assembled with the housing parts 20, 22 in the same fashion. The axles 24, 26, 28, 30 cooperatively maintain the housing parts 20, 22 assembled and in a predetermined spaced relationship so that a chamber 44 is defined between the housing parts 20, 22 to accommodate operational components, as hereinafter described. In the embodiment shown, the housing parts 20, 22 each have a generally cup-shaped configuration so that, once mated, a substantial portion of the chamber 44 is enclosed by the housing parts 20, 22.

In the embodiment shown, the housing parts 20, 22 are formed from metal sheet material. However, the housing parts 20, 22 could be made from virtually any material and could be molded in the shape shown, as opposed to being formed.

Figure 3:
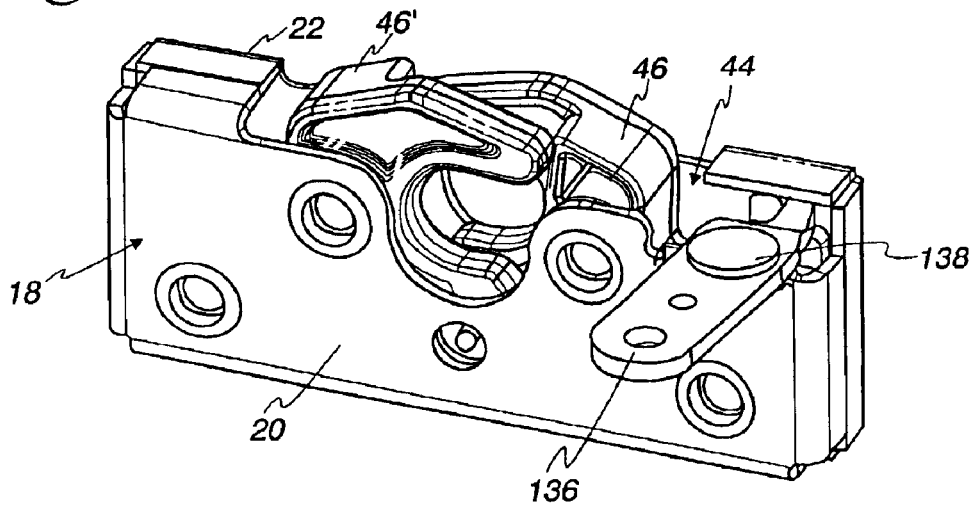
FIG. 3 is an enlarged, perspective view of the latch assembly in FIG. 2 in an assembled state and with rotors on the latch assembly in a primary latched position.

In addition to their function of interconnecting and spacing the housing parts 20, 22, the axles 24, 26, 28, 30 serve as a support for certain of the internal components of the latch assembly 10. More specifically, the axles 26, 28 support rotors 46, 46' for pivoting movement between a release position, shown in dotted lines in FIG. 4, a primary latched position, as shown in FIG. 3, and a secondary latched position, as shown in FIG. 5. The rotors 46, 46' shown have an identical construction, however, the rotors 46, 46' may have different configurations. Exemplary rotor 46 has a U-shaped body 50 with a thickened base portion 52 having a thickness T that is slightly less than the spacing in the chamber 44 between the housing parts 20, 22. Legs 54, 56, having a thickness t equal to approximately one-half the thickness T of the base part 52, project at spaced locations from the base part 52 so as to define a U-shaped throat 58 therebetween. The base part 52 and legs 54, 56 are flush on one side 60 of the rotor 46 so that the base part 52 and legs 54, 56 reside in a single plane at that side 60. The rotor 46 has a through bore 62 to receive the axle 26 so that the rotor 46 is guided in pivoting by the axle 26 around an axis 64 defined by the axle 26.

The rotor 46' is reversed from the rotor 46 and mounted on the axle 28 for pivoting movement relative to the housing 18 about an axis 66, that is parallel to the axis 64. With this arrangement, the legs 54, 56 on the rotor 46, and corresponding legs 54', 56' on the rotor 46', move relative to each other in a scissors-type action, parallel to a reference plane 67, as the rotors 46, 46' are changed between their release positions and primary latched positions.

Figure 4:
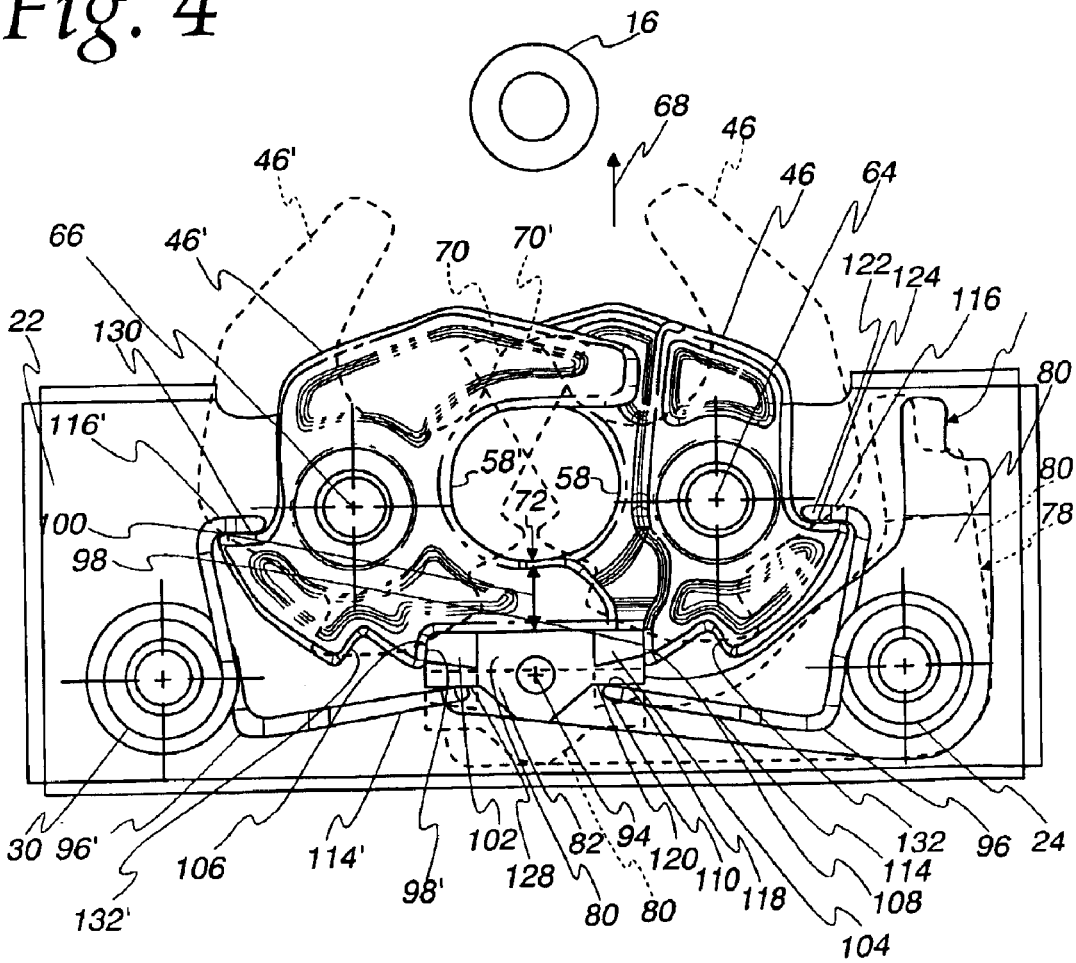
FIG. 4 is an enlarged, side elevation view as in FIG. 3 with a housing portion removed and showing the rotors in release positions in phantom lines and in primary latched positions in solid lines.
Figure 5:
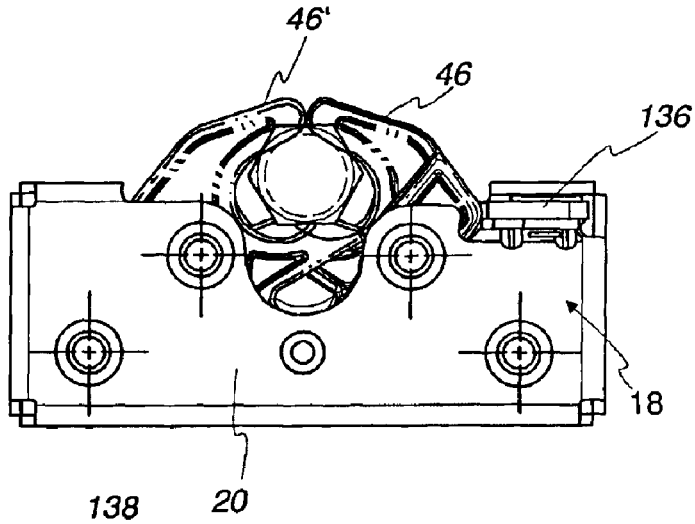
FIG. 5 is a side elevation view, corresponding to that in FIG. 4, with the rotors in a secondary latched position.
Figure 6:
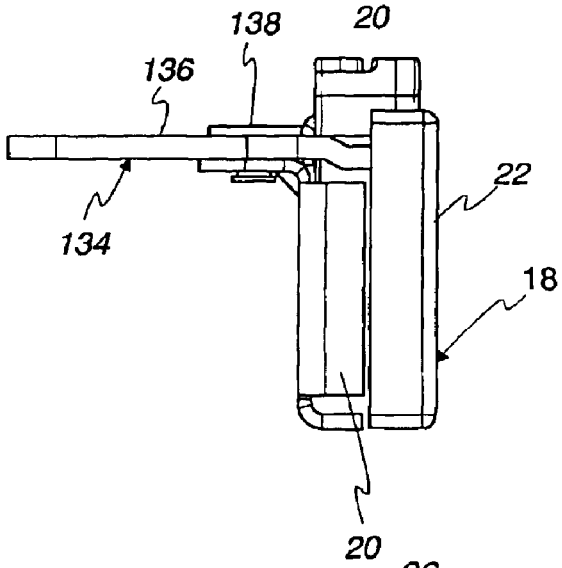
FIG. 6 is an end elevation view of the assembled latch assembly in FIGS. 2–5.

With the rotors 46, 46' in their release positions, as shown in dotted lines in FIG. 4, the closure element 12 can be moved from a first position therefor into a second position. As the closure element 12 approaches the second position, the latch assembly 10 moves in the direction of the arrow 68 towards the strike element 16. The strike element 16 initially contacts inclined cam surfaces 70, 70' on the rotor legs 56, 56', respectively. Continued movement of the closure element 12 towards its second position causes the strike element 16 to progressively urge the rotor 46 about the axis 64 from its release position, shown in phantom lines in FIG. 4, in a counterclockwise direction into the primary latched position, shown in solid lines. The rotor 46' is simultaneously moved about its axis 66 in a clockwise direction from the release position into the primary latched position, shown in phantom and solid lines, respectively, in FIG. 4. As the rotors 46, 46' progressively move from their release positions into their primary latched positions, the throats 58, 58' on the rotors 46, 46' progressively overlap and cooperatively receive the strike element 16. The scissors action of the legs 54, 56, 54', 56' causes the legs 54, 56, 54', 56' to progressively close about the strike element 16. With the rotors 46, 46' in the primary latched positions, the legs 54, 56, 54', 56' cooperatively bound a fully closed receptacle 72 within which the strike element 16 is captive.

The rotors 46, 46' are maintained in their primary latched positions by an operating assembly at 78. The operating assembly 78 consists of a catch arm 80 on which a catch block 82 is mounted. The catch arm 80 has an L-shaped configuration with a long leg 84 and a short leg 86. The catch arm 80 is pivotably connected to the housing 18 at the juncture of the long and short legs 84, 86, for pivoting movement around an axis 88, that is generally parallel to the axes 64, 66.

The catch block 82 is connected at the free end 90 of the longer leg 84 of the catch arm 80 through a pin 92. Through the pin 92, the catch block 82 is pivotable relative to the catch arm leg 84 about an axis 94, which is generally parallel to the axes 64, 66, 88.

The operating assembly 78 is changeable between a primary latched state, shown in solid lines in FIG. 4, and an unlatched state, shown in dotted lines in FIG. 4. In the latched state, the operating assembly 78 releasably maintains both rotors 46, 46' in their primary latched positions. The catch arm 80 is movable relative to the housing 18 from a first position, shown in solid lines in FIG. 4, into a second position, shown in phantom lines in FIG. 4, to thereby change the operating assembly 78 from the latched state into the unlatched state. Movement of the catch arm 80 from its first position into its second position causes the catch block 82 to move from an engaged position, shown in solid lines in FIG. 4, into a disengaged position, shown in phantom lines in FIG. 4.

The catch block 82 is mounted "floatingly" to the catch arm 80, and can be angularly reoriented relative to the catch arm 80 and housing 18 around the axis 94, and translated relative thereto transversely to the axis 94, within a predetermined range, as described hereinbelow. Under the influence of two wire spring elements 96, 96', described in detail hereafter, the catch block 82 is biasably maintained in a predetermined, operating, angular orientation relative to the housing 18 and catch arm 80. The spring elements 96, 96' biasably urge the catch block 82 consistently into this orientation.

In the engaged position, the catch block 82 resides between facing stop surfaces 98, 98' on the rotors 46, 46', to thereby prohibit the rotors 46, 46' from pivoting out of their primary latched positions, i.e. by movement of the rotor 46 in a clockwise position around the axis 64 from its solid line position in FIG. 4 and the rotor 46' in a counterclockwise direction about the axis 66 from its solid line position in FIG. 4. By shifting the catch block 82 to the disengaged position, the catch block 82 is caused to clear out of the path of the rotors 46, 46', so that the rotors 46, 46' can move substantially unimpededly from their primary latched positions into their release positions. Because the catch block 82 is floatingly mounted upon the catch arm 80, the catch block 82 can move while maintaining the same angular orientation in substantially a straight line path, as indicated by the double-headed arrows 100, between the engaged and disengaged positions. This allows the catch block 82 to slide from between the stop surfaces 98, 98' with minimal resistance from the rotors 46, 46'. In the absence of this floating arrangement for the catch block 82, the arcuate path traveled by the catch block would force a certain amount of clockwise pivoting of the rotor 46' to allow the catch block 82 to clear away from the rotor 46' as the catch block 82 moves from the engaged position into the disengaged position.

The catch block 82 has thickened portions 102,104 with surfaces 106,108 which engage the rotors 46, 46' with the catch block 82 in the engaged position. Thus, a relatively large contact area between the rotor surfaces 98, 98' and catch block surfaces 106,108 can be established. This large contact area assures that the catch block 82 and rotors 46, 46' firmly abut to each other and also reduces potential wear resulting from the repetitive contact between the rotor and catch block surfaces 98, 98', 106, 108. At the same time, the fact that the catch block 82 slides from between the rotor surfaces 98, 98' in the same operating angular orientation accounts for relatively little resistance between the catch block 82 and rotors 46, 46', compared to what the resistance would be between these same sized surfaces if the catch block 82 were required to pivot the rotor 46', as previously described, as the catch block 82 moves out of the engaged position.

As noted above, by reason of the relatively large interactive surface areas between the catch block 82 and rotors 46, 46', wear on the cooperating parts can be controlled. This arrangement lends itself to the construction of both the rotors 46, 46' and catch block 82 from moldable material, such as plastics, composites, etc. While the rotors 46, 46' and catch block 82 may be made from metal, preferably these elements are made from a non-metal material. The non-metal material has numerous advantages. First of all, a material such as plastic can be readily and economically molded to desired shapes. Plastic material is generally lower in cost and lighter in weight than metal. Further, the plastic material is not prone to being corroded upon being exposed to moisture and chemicals commonly encountered in environments in which this type of latch assembly 10 is used.

Still further, there will normally be a lower coefficient of friction between the plastic and cooperating parts than that between like cooperating metal parts. Additionally, the need to lubricate between the plastic rotors 46, 46' and parts against which they act may be obviated.

The rotors 46, 46' are biased by the spring elements 96, 96' towards their release positions. The spring elements 96, 96' also bias the catch block 82 towards its engaged position. Both spring elements 96, 96' have the same construction. Exemplary spring element 96 will be described in detail herein.

Figure 2:
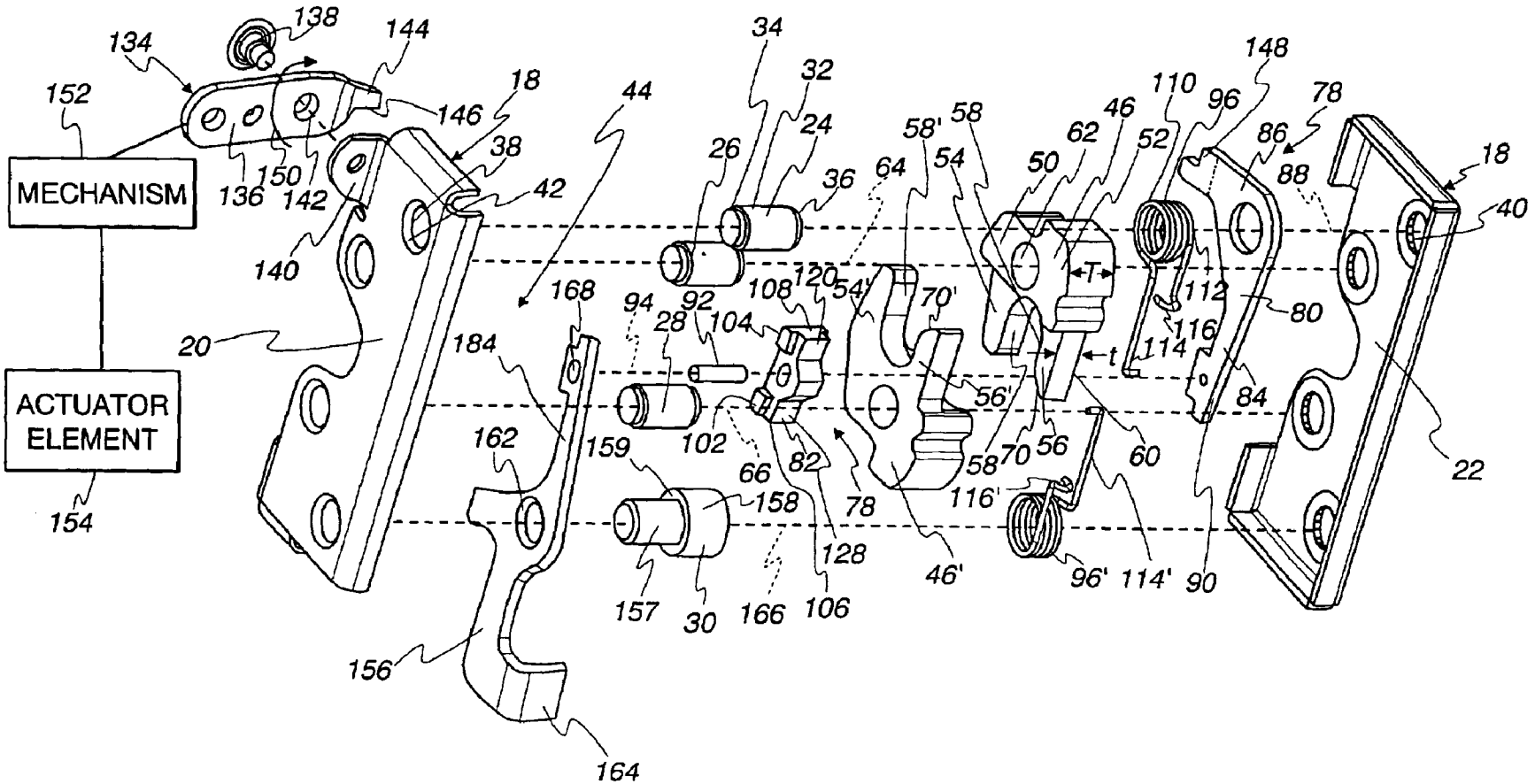
FIG. 2 is an exploded, perspective view of one form of latch assembly, according to the present invention.
Figure 7:
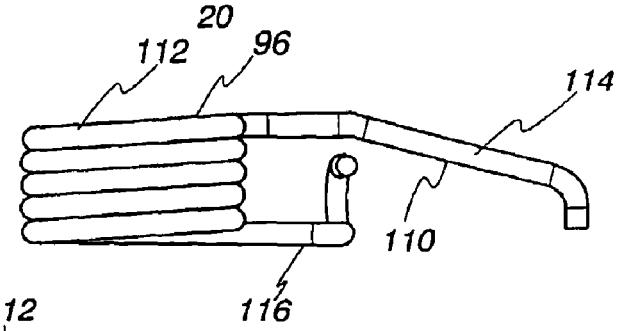
FIG. 7 is an enlarged, top view of a wire spring for biasing one of the rotors into its release position and for biasing a catch block towards a position wherein the catch block releasably maintains the one rotor selectively in each of its primary and secondary latched positions.
Figure 8:
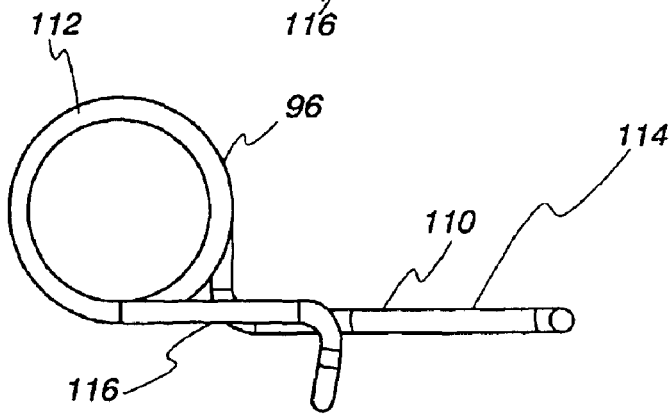
FIG. 8 is an enlarged, side elevation view of the spring in FIG. 7.

As seen most clearly in FIGS. 7 and 8, taken in conjunction with FIGS. 2 and 4, the spring element 96 is defined by a formed wire 110. The formed wire 110 has a coiled center 112, which surrounds the axle 24, and free ends 114, 116 projecting therefrom. The free end 114 is loaded so that an offset end 118 bears on a shoulder 120 at a first location on the catch block 82, thereby urging the catch block 82 towards the engaged position therefor. The spring end 116 has an offset portion 122 which is loaded to bear against a shoulder 124 on the rotor 46, to thereby urge the rotor 46 in a clockwise direction about the axis 64 in FIG. 4, i.e. towards the release position for the rotor 46.

The spring element 96' is mounted around the axle 30 and has corresponding free ends 114', 116', which bear respectively on a shoulder 128 on the catch block 82 and a shoulder 130 on the rotor 46', to thereby urge the catch block 82 towards the engaged position and the rotor 46' towards its release position.

The spring elements 96, 96' produce a balanced, biasing force on the catch block 82 at spaced locations on opposite sides of the pivot axis 94 to thereby urge the catch block 82 into its desired operating angular orientation relative to the housing 18 and catch arm 80. At the same time, the spring elements 96, 96' exert a force on the catch arm 80, through the catch block 82, urging the catch arm to its first position, as shown in solid lines in FIG. 4.

The rotors 46, 46' have stop surfaces 132,132', which function in the same manner as the stop surfaces 98, 98', previously described, in conjunction with the catch block 82. The stop surfaces 132, 132' engage the catch block 82 with the rotors 46, 46' in a secondary latched position, shown in FIG. 5.

In operation, with the rotors 46, 46' in their release positions, repositioning of the closure element 12 causes the strike element 16 to bear upon the cam surfaces 70, 70'. Continued movement of the closure element 12 causes the strike element to pivot the rotors 46, 46' towards their primary latched positions. As this is occurring, the catch block 82 is constantly biasably urged against the rotors 46, 46'. Eventually, the catch block 82 moves between the stop surfaces 132, 132' into engaged position with the rotors 46, 46', thereby maintaining the rotors 46, 46' in the secondary latched position of FIG. 5. Continued movement of the closure element 12 wedges the catch block 82 out of engagement with the stop surfaces 132, 132' and drives the rotors 46, 46' further toward the primary latched positions therefor, at which point the catch block 82 moves between the stop surfaces 98, 98', to releasably maintain the rotors 46, 46' in their primary latched positions.

When it is desired to release the strike element 16, an actuator 134 is operated to change the catch arm 80 from its first position to its second position, thereby moving the catch block 82 from its engaged position into its disengaged position. As this occurs, the catch block 82 moves out of the path of the rotors 46, 46', whereupon the spring elements 96, 96' drive the rotors 46, 46' back into their release positions.

The actuator 134 is shown in this embodiment as an arm 136 which is pivotably connected through a pin 138 to a tab 140 on the housing part 20. The resulting pivot axis 142 for the arm 136 is orthogonal to the pivot axis 88 for the catch arm 80. The arm 136 has an extension 144 with a cam edge 146 which bears on an inset cam edge 148 on the catch arm 80. Pivoting movement of the arm 136 in the direction of the arrow 150 around the axis 142 pivots the catch arm 80 between the first and second positions therefor. The actuator 134 may be directly graspable or operated through a linkage or other mechanism 152, which may in turn have an actuator element 154 that is directly operable by the user.

A secondary actuator 156 (FIG. 2) is optionally provided to effect operation of the latch assembly 10 from a location spaced from that of the actuator 134. The actuator 156 is mounted on the axle 30. The axle 30 has a stepped diameter with a reduced diameter portion 157, a larger diameter portion 158, and an annular shoulder 159 at the juncture therebetween. The reduced diameter portion 157 extends through a mounting opening 162 in the actuator 156. The shoulder 159 confines movement of the actuator 156 axially along the axle. The actuator 156 has a graspable, or otherwise engageable, actuating tab 164 through which the actuator 156 can be pivoted about the axis 166 of the axle 30.

A through bore 168 is provided in the actuator 156 at a location remote from the actuating tab 164. The bore 168 receives the pin 92 on the catch block 82. By pivoting the actuator 156 about its axis 166, the catch block 82 can be selectively moved between the engaged and disengaged positions therefor.

Figure 9:
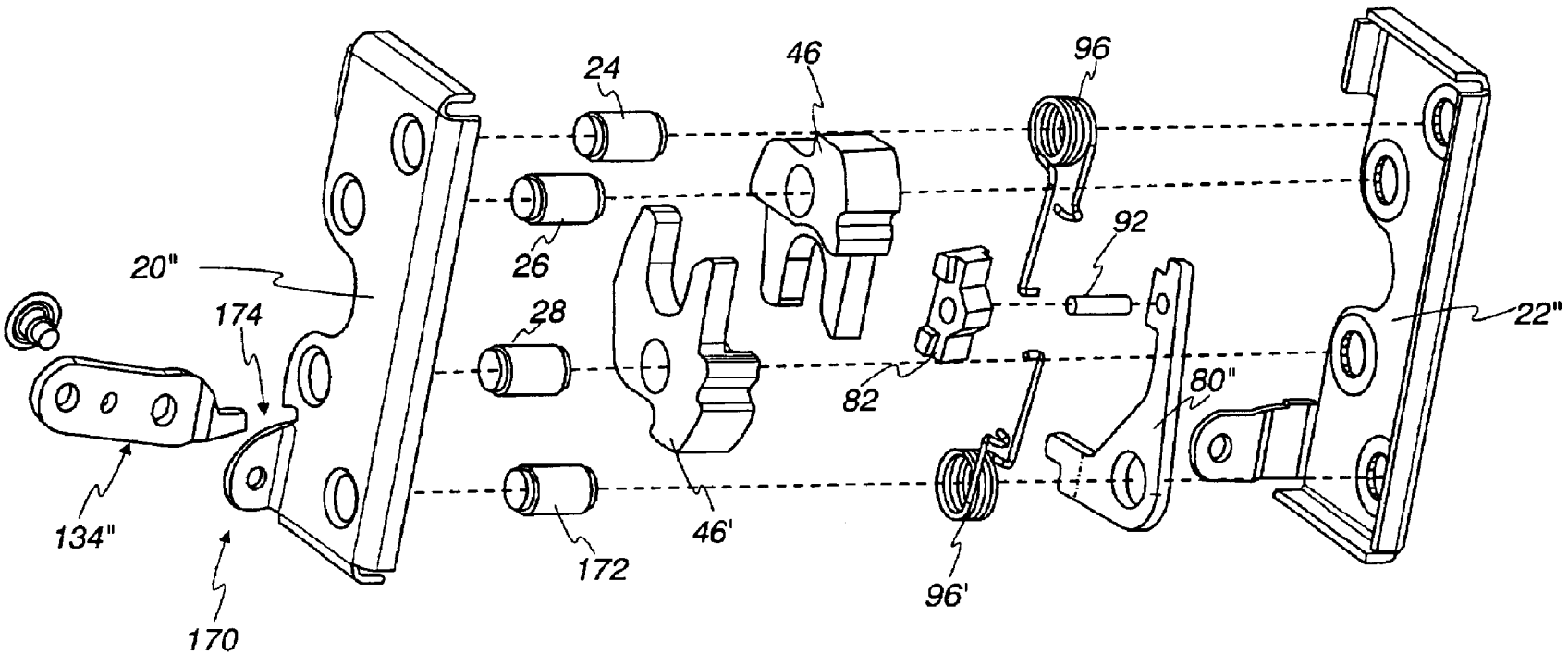
FIG. 9 is a view as in FIG. 2 of a modified, opposite-handed form of latch assembly, according to the present invention.

In FIG. 9, a modified version of the latch assembly is shown at 170. The latch assembly 170 is opposite-handed from the latch assembly 10, previously described. The primary internal operating components are generally the same as those previously described and are correspondingly numbered in FIG. 9, with a few exceptions. In the latch assembly 170, the secondary actuator 156 is omitted. The flanged axle 30 is replaced with an axle 172 that is the same as the axles 24, 26, 28. The catch arm 80", corresponding to the catch arm 80, is reversed, as is the mounting location at 174 for an actuator 134", corresponding to the actuator 134, on housing parts 20", 22".

Figure 10:
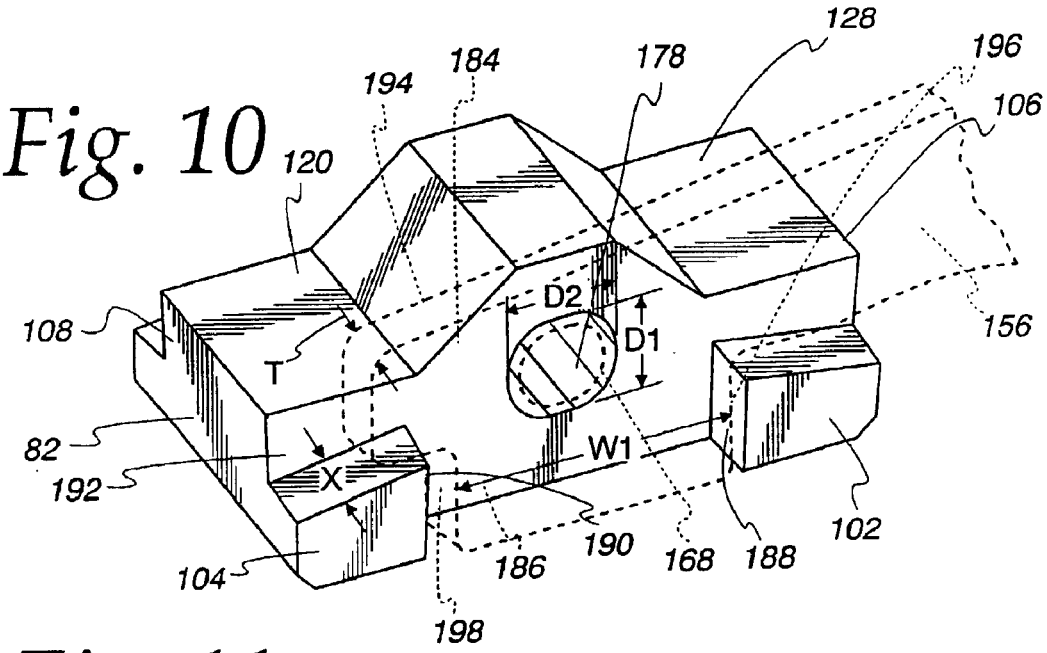
FIG. 10 is an enlarged, side perspective view of the inventive catch block in relationship to a portion of an actuator therefor, shown in dotted lines.
Figure 11:
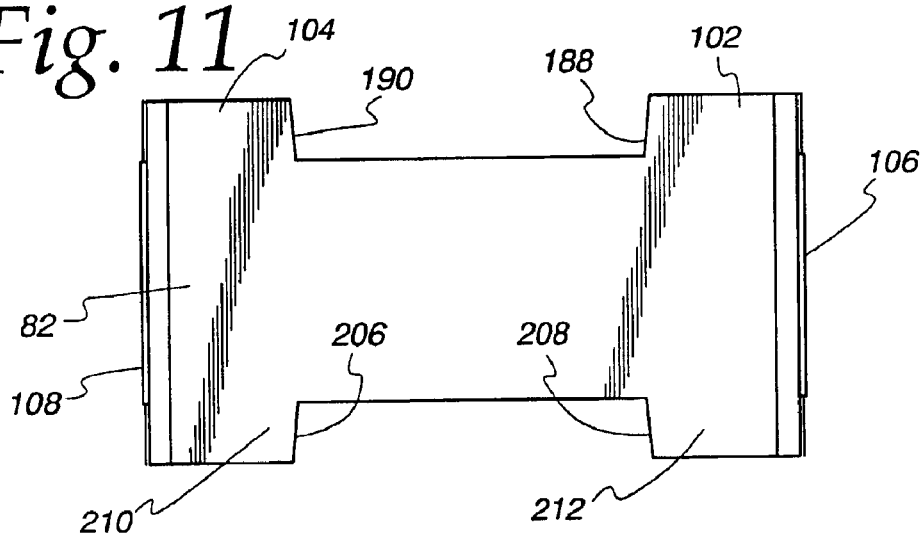
FIG. 11 is an enlarged, bottom view of the catch block of FIG. 10.
Figure 12:
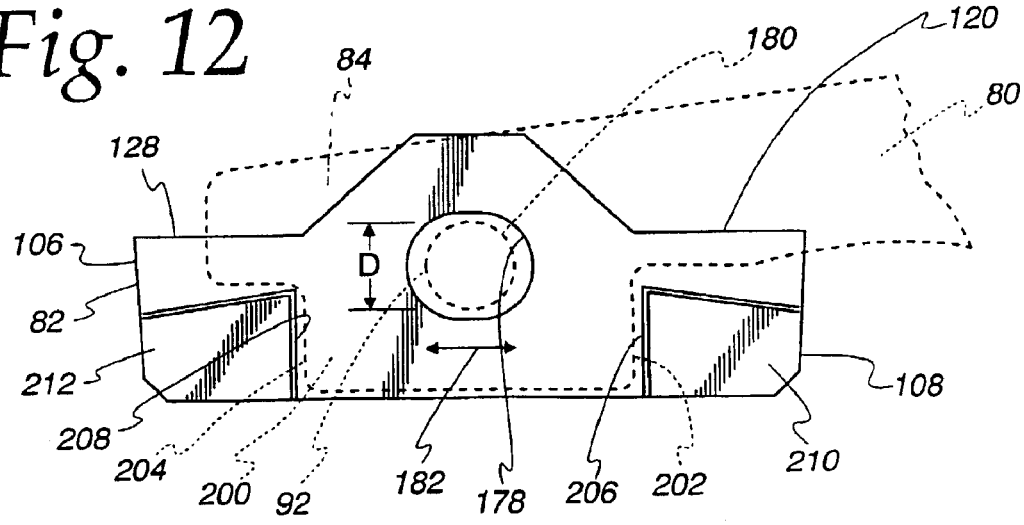
FIG. 12 is an enlarged, elevation view of the catch block, from the side opposite that in FIG. 10, in relationship to a portion of an actuatable catch arm, shown in dotted lines.

In both embodiments described above, the catch block 82 cooperates with the pin 92 so as to be translatable transversely to the pin axis. More specifically, as shown in FIGS. 10–12, the catch block 82 has an elliptical through bore 178 which accepts the pin 92. The pin 92 has a circular outer surface 180 with a diameter D (FIG. 12), which is slightly less than the bore dimension D1 (FIG. 10) along the minor axis of the bore 178, and more substantially less than the dimension D2 of the bore 178 along the major axis thereof. Accordingly, a modicum of shifting of the catch block 82 is permitted along the major axis, as indicated by the double-headed arrow 182. This adds another dimension to the floating movement of the catch block 82 relative to the pin 92, which is in a fixed orientation between the catch arm 80 and actuator 156.

To avoid excessive repositioning of the catch block 82, as might cause binding of the catch block 82 with the rotors 46, 46', the floating movement of the catch block 82 is confined by structure cooperating between the catch block 82 and the catch arm 80 and actuator 156. Referring initially to FIG. 10, the structure cooperating between the actuator 156 and catch block 82 is shown in greater detail. The actuator 156 has an elongate arm 184 through which the bore 168 is formed. The arm 184 has an offset, squared tab 186 which fits loosely between facing surfaces 188, 190 on the thickened portions 102, 104 of the catch block 82. The thickened portions 102,104 project away from a flat catch block surface 192 a distance X, which is approximately equal to the thickness T of the arm 184 and the tab 186 that is formed as one piece with the arm 184. Accordingly, with a flat surface 194 on the arm 184 confronting the mounting block surface 192, the tab 186 nests between the surfaces 188,190 so that oppositely facing tab edges 196, 198 confront substantially the entire area of the surfaces 188,190, respectively. The width W1 of the tab 186 is chosen to be slightly less than the spacing between the surfaces 188, 190. This permits a desired degree of shifting of the pin 92 along the major axis of the bore 178 and at the same time confines pivoting of the catch block 82 around the pin 92 to within a desired range, which may be on the order of 2–10°.

The catch block 82 cooperates with the catch arm 80 in the same manner, as shown in FIG. 12. The longer leg 84 of the catch arm 80 has a tab 200 with the same configuration as the tab 186, and performing the same function. The tab 200 has oppositely facing edges 202, 204 which reside between, and cooperate with, facing surfaces 206, 208 on thickened portions 210, 212, corresponding in shape and function to the oppositely projecting thickened portions 102, 104 on the opposite side of the catch block 82. The tabs 186, 200 thus redundantly perform the function of confining both translatory and pivoting movement of the catch block 82 relative to the actuator 156 and catch arm 80.

The foregoing disclosure of specific embodiments is intended to be illustrative of the broad concepts comprehended by the invention.

What is claimed is:

1. A latch assembly for a movable closure element, said latch assembly comprising:

a housing;

a first rotor movable relative to the housing selectively between a) a first latched position and b) a release position, the first rotor having a first throat to receive a strike element, the first rotor biased toward the release position; and an operating assembly having a latched state and an unlatched state, the operating assembly in the latched state releasably maintaining the first rotor in the first latched position, the operating assembly comprising a catch arm that is movable relative to the housing from a first position into a second position to thereby change the operating assembly from the latched state into the unlatched state, the operating assembly further comprising a catch block that is movable floatingly relative to the catch arm from a) an engaged position with the catch arm in the first position into b) a disengaged position as an incident of the catch arm moving from its first position into its second position, the catch block in the engaged position causing the first rotor to be maintained in the first latched position, wherein the catch block is mounted to the catch arm for pivoting movement relative to the catch arm around an axis and for translatory movement relative to the catch arm transversely to the axis.

2. The latch assembly according to claim 1 wherein the catch block in the engaged position directly engages the first rotor to maintain the first rotor in the first latched position.

3. The latch assembly according to claim 1 wherein the catch block has an angular orientation relative to the housing and the catch block is maintained in substantially the same angular orientation relative to the housing as the catch block changes between the engaged and disengaged positions.

4. The latch assembly according to claim 1 wherein the catch block is biased towards an operating angular orientation relative to the housing.

5. The latch assembly according to claim 4 wherein there is a single spring element that both biases the catch block toward the operating angular orientation and biases the first rotor toward the release position.

6. The latch assembly according to claim 5 wherein the single spring element comprises a formed wire.

7. The latch assembly according to claim 1 further comprising a second rotor movable relative to the housing selectively between a) a first latched position and b) a release position, the second rotor having a second throat to receive a strike element, the first and second rotors in their respective first latched positions arranged so that the first and second throats cooperatively define a receptacle for a strike element.

8. The latch assembly according to claim 7 wherein the second rotor is biased towards its release position.

9. The latch assembly according to claim 8 wherein the catch block in the engaged position causes the second rotor to be maintained in its first latched position.

10. The latch assembly according to claim 9 wherein the catch block is biased towards an operating angular orientation relative to the housing.

11. The latch assembly according to claim 10 wherein a bias force is exerted on the catch block at first and second spaced locations to thereby bias the catch block towards the operating angular orientation.

12. The latch assembly according to claim 11 wherein there is a first single spring element that exerts a bias force on the catch block at the first location to thereby bias the catch block towards the operating angular orientation and biases the first rotor towards its release position.

13. The latch assembly according to claim 12 wherein there is a second single spring element that exerts a bias force on the catch block at the second location to thereby bias the catch block towards the operating angular orientation and bias the second rotor towards its release position.

14. The latch assembly according to claim 1 wherein the catch block is pivotable relative to the catch arm around a first axis, the first rotor is pivotable relative to the housing around a second axis, the first and second axes are substantially parallel to each other, and the catch arm is pivotable relative to the housing between the first and second positions.

15. The latch assembly according to claim 1 wherein the catch block is pivotable relative to the catch arm around a first axis and the catch block and catch arm cooperate to limit pivoting of the catch block relative to the catch arm to a predetermined range.

16. The latch assembly according to claim 6 wherein the formed wire has a first free end and a second free end, the first free end is engaged with the catch block and the second free end is engaged with the first rotor.

17. The latch assembly according to claim 16 wherein the housing comprises first and second parts joined by an axle and the formed wire is wrapped around the axle.

18. The latch assembly according to claim 1 in combination with a movable closure element.

19. The latch assembly according to claim 18 in combination with a support for the closure element, the closure element movable relative to the support.

20. The latch assembly according to claim 1 wherein the first rotor is movable relative to the housing into a second latched position and the operating assembly has a second latched state wherein the operating assembly maintains the first rotor in the second latched position.

21. In combination:

a) a closure element;

b) a support for the closure element, the closure element mounted for selective movement relative to the support between first and second positions;

c) a strike element on the support; and d) a latch assembly on the movable closure element, the latch assembly comprising:

a housing;

a first rotor movable relative to the housing selectively between a) a first latched position and b) a release position, the first rotor engageable with the strike element with the closure element in its first position, the first rotor biased toward the release position; and an operating assembly having a latched state and an unlatched state, the operating assembly in the latched state releasably maintaining the first rotor in the first latched position, the operating assembly comprising a catch arm that is movable relative to the housing from a first position into a second position relative to the housing to thereby change the operating assembly from the latched state into the unlatched state, the operating assembly further comprising a catch block that is mounted on, and moveable floatingly relative to, the catch arm from a) an engaged position with the catch arm in the first position into b) a disengaged position as an incident of the catch arm moving from its first position into its second position, the catch block in the engaged position causing the first rotor to be maintained in the first latched position, wherein the catch block has an angular orientation relative to the housing and the catch block is maintained in substantially the same angular orientation relative to the housing as the catch block changes between the engaged and disengaged positions, wherein the catch block is biased towards the same angular orientation relative to the housing.

22. The combination according to claim 21 wherein the catch block in the engaged position directly engages the first rotor to maintain the first rotor in the first latched position, and the catch arm is pivotable relative to the housing around an axis between the first and second positions.

23. The combination according to claim 21 wherein the catch block is mounted for pivoting movement relative to the catch arm.

24. The combination according to claim 21 wherein there is a single spring element that both biases the catch block toward the operating angular orientation and biases the first rotor toward the release position.

25. The combination according to claim 24 wherein the single spring element comprises a formed wire.

26. The combination according to claim 24 further comprising a second rotor movable relative to the housing selectively between a) a first latched position and b) a release position, the second rotor having a second throat to receive a strike element, the first and second rotors in their respective first latched positions arranged so that the first and second throats cooperatively define a receptacle for a strike element.

27. The combination according to claim 25 wherein the second rotor is biased towards its release position.

28. The combination according to claim 26 wherein the catch block in the engaged position causes the second rotor to be maintained in its first latched position.

29. The combination according to claim 21 wherein a bias force is exerted on the catch block at first and second spaced locations to thereby bias the catch block towards the operating angular orientation.

30. The combination according to claim 21 wherein the operating assembly further comprises a first actuator element, movable relative to the catch arm, for moving the catch arm from its first position into its second position.

31. The combination according to claim 30 wherein the first actuator element comprises a graspable handle to facilitate movement of the first actuator element.

32. The combination according to claim 30 wherein the operating assembly further comprises a second actuator element, movable relative to the catch arm, for moving the catch arm from its first position into its second position.

33. The combination according to claim 32 wherein the second actuator element is movable relative to the catch arm without causing movement of the first actuator element.

34. The combination according to claim 21 wherein the first rotor is movable relative to the housing into a second latched position and the operating assembly has a second latched state wherein the operating assembly maintains the first rotor in the second latched position.

35. The combination according to claim 23 wherein the catch block and catch arm cooperate to limit pivoting of the catch block relative to the catch arm to a predetermined range.

* * * * *

UNITED STATES PATENT AND TRADEMARK OFFICE

CERTIFICATE OF CORRECTION

PATENT NO. : 6,942,259 B2
DATED : September 13, 2005
INVENTOR(S) : Ricci L. Marzolf et al.

It is certified that error appears in the above-identified patent and that said Letters Patent is hereby corrected as shown below:

Column 9,
Line 19, should read as follows:
-- that is movable floatingly relative to the catch arm and housing from --.

Signed and Sealed this

Fourth Day of April, 2006

JON W. DUDAS
*Director of the United States Patent and Trademark Office*